US010429760B2

(12) United States Patent
Tsukada

(10) Patent No.: US 10,429,760 B2
(45) Date of Patent: Oct. 1, 2019

(54) IMAGE FORMING APPARATUS

(71) Applicant: Brother Kogyo Kabushiki Kaisha, Nagoya-shi, Aichi-ken (JP)

(72) Inventor: Takamasa Tsukada, Ichinomiya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/843,349

(22) Filed: Dec. 15, 2017

(65) Prior Publication Data

US 2018/0173133 A1 Jun. 21, 2018

(30) Foreign Application Priority Data

Dec. 15, 2016 (JP) ..... 2016-243028
Dec. 15, 2016 (JP) ..... 2016-243030

(51) Int. Cl.
*G03G 15/04* (2006.01)
*G03G 21/16* (2006.01)

(52) U.S. Cl.
CPC ... *G03G 15/04054* (2013.01); *G03G 21/1619* (2013.01); *G03G 21/1666* (2013.01); *G03G 2215/0141* (2013.01); *G03G 2221/1636* (2013.01)

(58) Field of Classification Search
CPC ..... G03G 15/04036; G03G 15/04054; G03G 15/043; G03G 21/1619; G03G 21/1647; G03G 21/1666; G03G 2215/0407; G03G 2215/0409; G03G 2221/1636; G03G 2221/1654; G03G 2221/1678
USPC ..... 399/4, 118, 177, 205, 220
See application file for complete search history.

(56) References Cited

U.S. PATENT DOCUMENTS 6,055,006 A 4/2000 Murano
7,116,925 B2 10/2006 Yamaguchi
7,808,520 B2 10/2010 Nakajima
7,982,761 B2 7/2011 Yokoi
(Continued)

FOREIGN PATENT DOCUMENTS

JP H09-174919 A 7/1997
JP 2000-168132 A 6/2000
(Continued)

OTHER PUBLICATIONS

Dec. 15, 2017—Co-pending U.S. Appl. No. 15/843,038.
(Continued)

*Primary Examiner* — Benjamin R Schmitt
(74) *Attorney, Agent, or Firm* — Banner & Witcoff, Ltd.

(57) ABSTRACT

An image forming apparatus, including a photosensitive drum, an exposure head, a base frame, and a spring, is provided. The exposure head includes light emitters, a lens array, and a head frame, and is movable between an exposable position and a retracted position. The base frame supports the photosensitive drum and includes a reference face. The reference face is configured to define a position of the exposure head with regard to a sub-scanning direction, which is orthogonal to a direction of an optical axis of the light from the light emitters and to a direction of a rotation axis of the photosensitive drum, by being contacted by the head frame of the exposure head when the exposure head is at the exposable position. The spring is arranged in the head frame and presses the head frame toward the reference face.

9 Claims, 8 Drawing Sheets

(56) References Cited

U.S. PATENT DOCUMENTS

| | | | | |
|---|---|---|---|---|
| 8,203,587 | B2 | 6/2012 | Mikami et al. | |
| 8,698,860 | B2 | 4/2014 | Sugiyama et al. | |
| 8,725,028 | B2 | 5/2014 | Imai | |
| 8,755,715 | B2 | 6/2014 | Mori et al. | |
| 2002/0149664 | A1 | 10/2002 | Nagamine et al. | |
| 2006/0176538 | A1 | 8/2006 | Hirayama et al. | |
| 2007/0126852 | A1 | 6/2007 | Fukutome et al. | |
| 2008/0031655 | A1 | 2/2008 | Kondo | |
| 2008/0145103 | A1 | 6/2008 | Honobe et al. | |
| 2009/0169261 | A1 | 7/2009 | Yokoi | |
| 2009/0202272 | A1 | 8/2009 | Nakashima | |
| 2009/0220272 | A1 | 9/2009 | Mikami et al. | |
| 2009/0256872 | A1 | 10/2009 | Yamakawa et al. | |
| 2009/0322850 | A1* | 12/2009 | Tamaru | B41J 25/308 347/245 |
| 2009/0322851 | A1 | 12/2009 | Yokoi et al. | |
| 2010/0020155 | A1 | 1/2010 | Tamaru et al. | |
| 2010/0020301 | A1 | 1/2010 | Sugiyama et al. | |
| 2010/0054813 | A1 | 3/2010 | Tamaru et al. | |
| 2010/0271639 | A1 | 10/2010 | Iijima | |
| 2011/0255905 | A1 | 10/2011 | Yokoi | |
| 2012/0027450 | A1 | 2/2012 | Imai | |
| 2013/0259521 | A1 | 10/2013 | Sugiyama | |
| 2013/0278705 | A1 | 10/2013 | Nakamura et al. | |
| 2014/0204167 | A1 | 7/2014 | Yokoi et al. | |
| 2016/0026111 | A1 | 1/2016 | Arasawa et al. | |

FOREIGN PATENT DOCUMENTS

| | | | |
|---|---|---|---|
| JP | 2002-361931 | A | 12/2002 |
| JP | 2008-207418 | A | 9/2008 |
| JP | 2009-012281 | A | 1/2009 |
| JP | 2009-157142 | A | 7/2009 |
| JP | 2009-208295 | A | 9/2009 |
| JP | 2010-006004 | A | 1/2010 |
| JP | 2012-025130 | A | 2/2012 |
| JP | 2013-022837 | A | 2/2013 |
| JP | 2013-203039 | A | 10/2013 |

OTHER PUBLICATIONS

Oct. 17, 2018—U.S. Notice of Allowance—U.S. Appl. No. 15/843,038.
Mar. 27, 2019—(US) Notice of Allowance—U.S. Appl. No. 16/257,803.

* cited by examiner

IMAGE FORMING APPARATUS

CROSS REFERENCE TO RELATED APPLICATION

This application claims priority under 35 U.S.C. § 119 from Japanese Patent Applications Nos. 2016-243028 and 2016-243030, both filed on Dec. 15, 2016. The entire subject matters of the applications are incorporated herein by reference.

BACKGROUND

Technical Field

As aspect of the present disclosure is related to an image forming apparatus including an exposure head, which may expose a photosensitive drum to light.

Related Art

An image forming apparatus having an exposure head is known. The exposure head may be urged frontward at sideward end portions thereof by arms attached to sideward areas in a main frame so that the sideward end portions of the exposure head may be urged against contact portions at the sideward areas in the main frame. Thus, the exposure head may be located at a correct position in the main frame with regard to a front-rear direction.

SUMMARY

Meanwhile, when assembling the image forming apparatus, the arms to urge the exposure head may be attached pivotably to the main frame after the exposure head is installed in the image forming apparatus. In particular, the arms may be attached to one side and the other side of the main frame of the image forming apparatus after the installation of the exposure head, and the contact portions may be placed in the sideward areas in the main frame before the installation for the exposure head. Therefore, the exposure head and other neighboring items in the image forming apparatus may be installed in the main frame in consideration of arrangement of the arms so that the arms may be attached to the main frame without being interfered with by the exposure head and the other items. In this regard, freedom in layout of the components in a body of the image forming apparatus may be limited.

The present disclosure is advantageous in that an image forming apparatus, in which freedom in layout of components in a body thereof may be increased, is provided.

According to an aspect of the present disclosure, an image forming apparatus, including a photosensitive drum, an exposure head, a base frame, and a spring, is provided. The exposure head includes a plurality of light emitters aligned along a direction of a rotation axis of the photosensitive drum, a lens array focusing light from the light emitters on the photosensitive drum, and a head frame supporting the light emitters and the lens array. The exposure head is movable between an exposable position, in which the photosensitive drum is exposed to the light, and a retracted position, in which the exposure head is further apart from the photosensitive drum than the exposure head being in the exposable position. The base frame supports the photosensitive drum and includes a reference face. The reference face is configured to define a position of the exposure head with regard to a sub-scanning direction, which is orthogonal to a direction of an optical axis of the light and to the direction of the rotation axis, by being contacted by the head frame of the exposure head when the exposure head is at the exposable position. The spring is arranged in the head frame and presses the head frame toward the reference face.

According to another aspect of the present disclosure, an image forming apparatus, including a photosensitive drum, an exposure head, and a base frame, is provided. The exposure head includes a plurality of light emitters aligned along a direction of a rotation axis of the photosensitive drum, a lens array focusing light from the light emitters on the photosensitive drum, and a head frame supporting the light emitters and the lens array. The exposure head is movable between an exposable position, in which the photosensitive drum is exposed to the light, and a retracted position, in which the exposure head is further apart from the photosensitive drum than the exposure head being in the exposable position. The base frame supports the photosensitive drum and includes a reference face. The reference face is configured to define a position of the exposure head with regard to a sub-scanning direction, which is orthogonal to a direction of an optical axis of the light and to the direction of the rotation axis, by being contacted by the head frame of the exposure head when the exposure head is at the exposable position. The reference face includes a first reference face, which is arranged on one side of the base frame with regard to the direction of the rotation axis, and a second reference face, which is arranged on the other side of the base frame with regard to the direction of the rotation axis. The first reference face is arranged on one side of the head frame with regard to the sub-scanning direction, and the second reference face is arranged on the other side of the head frame with regard to the sub-scanning direction. The image forming apparatus further includes a first spring, which is configured to press the head frame toward the first reference face, and a second spring, which is configured to press the head frame toward the second reference face.

BRIEF DESCRIPTION OF THE ACCOMPANYING DRAWINGS

DETAILED DESCRIPTION

Hereinafter, an embodiment of the present disclosure will be described with reference to the accompanying drawings. An overall configuration and a detailed configuration of a color printer 1 being an example of an image forming apparatus will be described in the following paragraphs.

In the following description, directions related the color printer 1 and each part or item included in the color printer 1 will be mentioned on basis of directions pointed by arrows in each drawing. For example, in FIG. 1, a viewer's left-hand side and right-hand side will be referred to as a frontward side and a rearward side, respectively. A viewer's near side and far side in FIG. 1 will be referred to as a rightward side and a leftward side of the color printer 1, respectively. An up-to-down or down-to-up direction in FIG. 1 may be referred to as a vertical direction, and a front-to-rear or rear-to-front direction may be referred to as a front-rear direction. Further, a left-to-right or right-to-left direction may be referred to as a widthwise direction.

Figure 1:
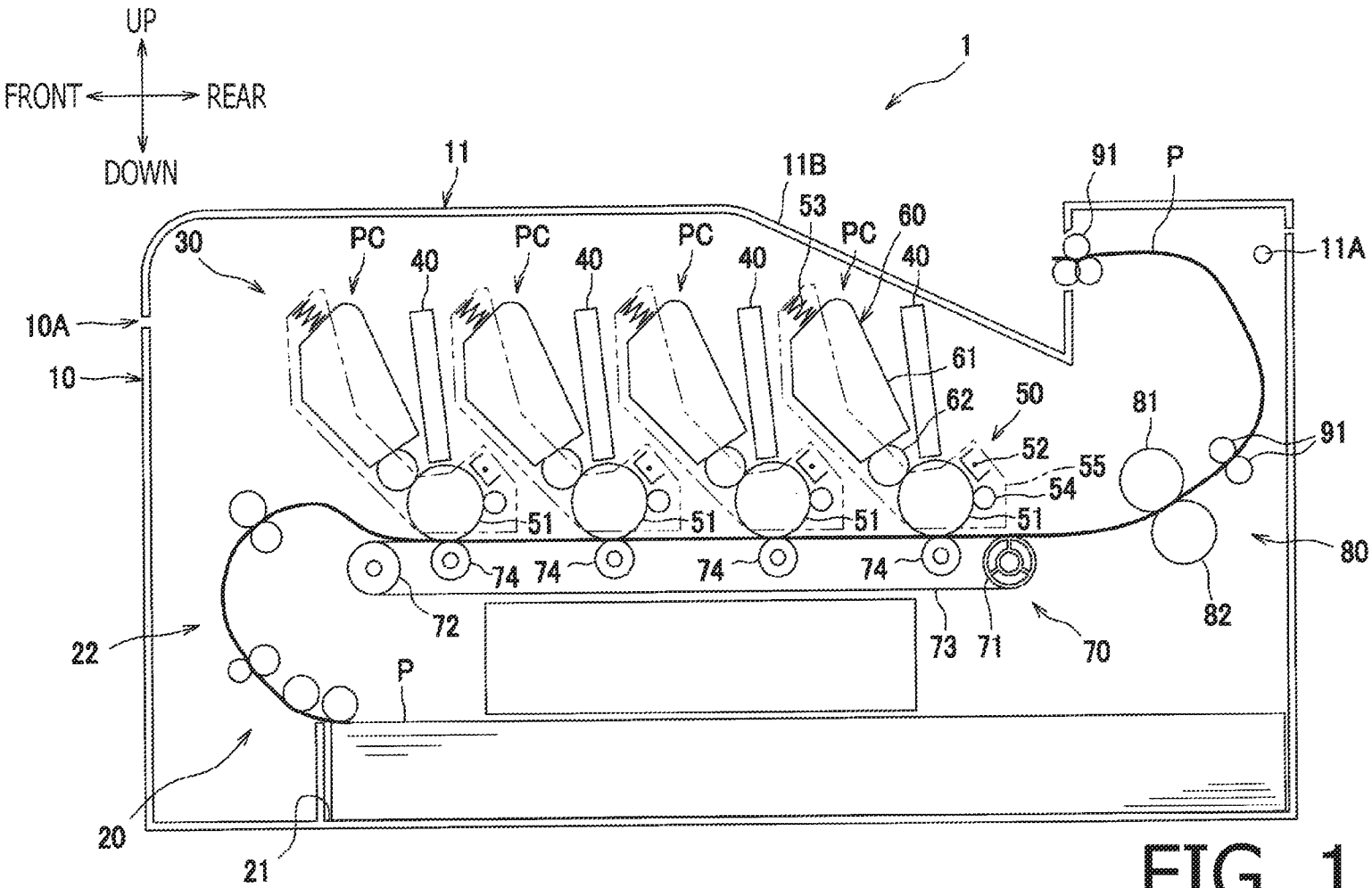
FIG. 1 is an illustrative cross-sectional view of a color printer according to an embodiment of the present disclosure.

As shown in FIG. 1, the color printer 1 includes a main frame 10, a cover 11, a sheet feeder 20, and an image forming unit 30. The sheet feeder 20 and the image forming unit 30 are accommodated in the main frame 10.

The cover 11 is arranged on one side of exposure heads 40 opposite to photosensitive drums 51 with regard to the vertical direction, i.e., at a position on an upper side of the main frame 10. The cover 11 is supported by the main frame 10 to be pivotable with respect to the main frame 10 about a pivot axis 11A to open or close an opening 10A formed at an upper area in the main frame 10. In particular, the cover 11 is pivotable about the pivot axis 11A, which is located on the rearward side of the photosensitive drums 51 at a position apart from the photosensitive drums 51 along the front-rear direction and extends in parallel with the widthwise direction. The cover 11 is pivotable between a closure position (see FIG. 1), in which the cover 11 closes the opening 10A, and an open position (see FIG. 2), in which the cover 11 opens the opening 10A.

The sheet feeder 20 is arranged at a lower position in the main frame 10. The sheet feeder 20 includes a feeder tray 21 to store sheets P and a feeder device 22 to feed the sheets P to the image forming unit 30. The sheets P in the feeder tray 21 may be separated from one another by the feeder device 22 and fed to the image forming unit 30.

The image forming unit 30 includes a plurality of, e.g., four (4), exposure heads 40, a plurality of, e.g., four (4), process cartridges PC, a transfer unit 70, and a fuser unit 80. In the following description, two or more identical items may be represented by one of them, and description of the other identical item(s) may be omitted. For example, description of the four exposure heads 40 may be represented by one of the exposure heads 40, and description of the other three (3) exposure heads 40 may be omitted.

Each exposure head 40 includes a plurality of LEDs at one end thereof and is supported at the other end by the cover 11, more specifically, a holder 12 which will be described later in detail, to hang down from the cover 11. In other words, the cover 11 holds the exposure heads 40 through the holder 12. The exposure head 40 is arranged to face one of four (4) photosensitive drums 51 from above when the cover 11 is in the closure position. In particular, the exposure head 40 is movable, along with the cover 11, between an exposable position (see FIG. 1), in which the photosensitive drum 51 may be exposed to light from the exposure head 40, and a retracted position (see FIG. 2), in which the exposure head 40 is further apart from the photosensitive drum 51 than the exposure head 40 being in the exposable position. The LEDs in the exposure head 40 may blink on or off selectively based on image data so that a surface of the photosensitive drum 51 may be exposed to the light from the LEDs. Detailed configuration of the exposure head 40 will be described later.

The process cartridges PC are arranged between the cover 11 and the feeder tray 21 to align along the front-rear direction. Each process cartridge PC, in particular, a drum frame 55 in the process cartridge PC, is attachable to and detachable from the main frame 10 through the opening 10A when the cover 11 is in the open position (see FIG. 2). The process cartridge PC includes a drum unit 50 and a developing cartridge 60 which is attachable to and detachable from the drum unit 50.

The drum unit 50 includes the photosensitive drum 51, which has a cylindrical shape, a charger 52 to charge the photosensitive drum 51, an expandable spring 53 to urge the developing cartridge 60 toward the photosensitive drum 51, a cleaning roller 54, and the drum frame 55 to support the photosensitive drum 51 and other parts.

The cleaning roller 54 is a roller to remove obstacles such as residual toner from the photosensitive drum 51. The cleaning roller 54 contacts the photosensitive drum 51 and is rotatable on the photosensitive drum 51.

The developing cartridge 60 includes a toner container 61 to contain toner and a developing roller 62 to supply the toner from the toner container 61 to the photosensitive drum 51.

The transfer unit 70 is arranged between the feeder tray 21 and the process cartridges PC. The transfer unit 70 includes a driving roller 71, a driven roller 72, a conveyer belt 73 being an endless belt strained around the driving roller 71 and the driven roller 72, and four (4) transfer rollers 74. The conveyer belt 73 is in such an arrangement that an outer surface of the conveyer belt 73 contacts the photosensitive drums 51, and the transfer rollers 74 are arranged on an inner side of the conveyer belt 73 to nip the conveyer belt 73 with the photosensitive drums 51.

The fuser unit 80 is arranged at a position rearward from the process cartridges PC and the transfer unit 70. The fuser unit 80 includes a heat roller 81 and a pressure roller 81 arranged to face the heat roller 81. The pressure roller 82 is pressed against the heat roller 81.

In the image forming unit 30 configured as above, the surfaces of the photosensitive drums 51 may be evenly charged by the chargers 52 and selectively exposed to the light from the exposure heads 40 so that electrostatic latent images based on the image data may be formed on the photosensitive drums 51. Thereafter, the toner may be supplied from the developing rollers 62 to the photosensitive drums 51 so that the electrostatic latent images may be developed to be visible toner images on the photosensitive drums 51.

The toner images formed on the photosensitive drums 51 may be transferred consecutively onto the sheet P being conveyed on the conveyer belt 73 in layers by the transfer rollers 74. The sheet P with the transferred toner images may be conveyed through a position between the heat roller 81 and the pressure roller 82 so that the toner images may be thermally fixed on the sheet P. The sheet P may be ejected by the conveyer roller 91 outside the main frame 10 and rest on an ejection tray 11B formed on top of the cover 11.

Figure 3:
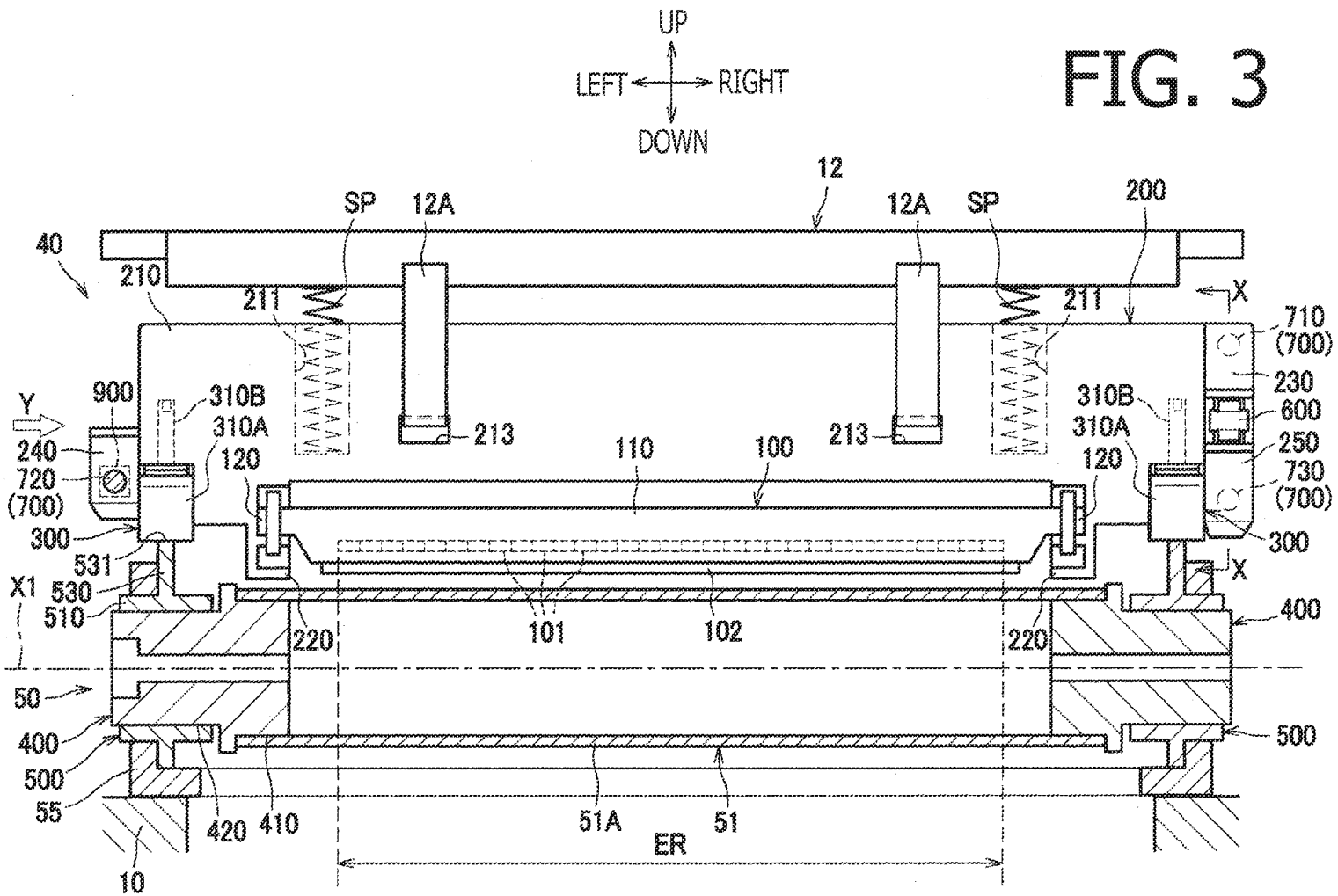
FIG. 3 is an illustrative view of an exposure head being at an exposable position and a drum unit according to the embodiment of the present disclosure.

Next, described below will be a configuration of the exposure heads 40. The photosensitive drum 51 as shown in FIG. 3 is rotatable about a rotation axis X1, which extends in the widthwise direction. In the following description, the direction of the rotation axis X1, i.e., the widthwise direction, to the photosensitive drum 51 may be referred to as a rotation axis direction.

The photosensitive drum 51 includes a base tube 51A, which is in a cylindrical shape, and two (2) fit-in members 400, which are fitted to an inner circumferential surface of the base tube 51A. The base tube 51A may be made of a conductive material such as metal. On an outer circumferential surface of the base tube 1A, formed is a photosensitive layer, which is not shown. In the following description, the outer circumferential surface of the base tube 51A including the photo sensitive layer may be referred to as the surface of the photosensitive drum 51. The photosensitive layer is formed to extend beyond an exposable range ER of the exposure head 40 with regard to the rotation axis direction. The base tube 51A is conductive with metal parts arranged in the main frame 10 to be connected to the ground potential.

One and the other of the fit-in members 400 are arranged in end areas in the base tube 51A on one side and the other side along the rotation axis direction, respectively. The fit-in members 400 are made of resin. The fit-in members 400 are fitted to the inner circumferential surface of the base tube 51A and are rotatable along with the base tube 51A. Each fit-in member 400 includes a fit-in portion 410 and an outer portion 420, which are formed integrally. The fit-in portion 410 is arranged on an inner side of an end face of the base tube 51A with regard to the rotation axis direction. The outer portion 420 is arranged on an outer side of the end face of the base tube 51A with regard to the rotation axis direction.

The photosensitive drum 51 is rotatably supported by rotation-supporting members 500 at each axial end portions thereof. The rotation-supporting members 500 are arranged at axial end areas of the photosensitive drum 51 on one side and the other side along the rotation axis direction and are supported by the drum frame 55. The drum frame 55 is, when attached to the main frame 10, supported by the main frame 10.

According to the present embodiment, the drum frames 55 to support the photosensitive drums 51 rotatably through the rotation-supporting members 500 and the main frame 10 to support the drum frames 55 may form a base frame. In other words, the base frame to support the photosensitive drums 51 includes the drum frames 55 and the main frame 10.

Each of the rotation-supporting members 500 supports the outer circumferential surface of a supported portion 421 in the fit-in member 400 rotatably. The rotation-supporting member 500 is made of resin and includes a sliding bearing. In particular, the rotation-supporting member 500 includes a bearing portion 510, which is in a cylindrical shape to rotatably support the fit-in member 400, and an extended portion 530, which extends from the bearing portion 510 toward the exposure head 40.

The extended portion 530 includes a contact face 531, which may be contacted by the exposure head 40, at a tip end thereof. The contact face 531 may contact a gap-adjusting member 300 in the exposure head 40 to define a distance between a lens array 102 and the photosensitive drum 51 in a direction of an optical axis, which will be described below.

The exposure head 40 includes a first frame 100, a second frame 200, the gap-adjusting members 300 arranged between the second frame 200 and the drum unit 50, in particular, the rotation-supporting members 500 in the drum unit 50, and a first presser 600.

The first frame 100 and the second frame 200 together form a head frame being a frame to the exposure head 40. In other words, the head frame includes the first frame 100 and the second frame 200. The first frame 100 and the second frame 200 are made of resin.

The first frame 100 includes a base portion 110 and two (2) extended portions 120, which are formed integrally. The base portion 110 is made of resin and extends approximately in a rectangular shape longer in the widthwise direction. The extended portions 120 extend outward in the widthwise direction from widthwise end faces of the base portion 110. The base portion 110 is made of resin and is open vertically.

Inside the base portion 110, arranged is an LED array 101 including a plurality of LEDs, which align along the rotation axis direction. At a lower opening of the base portion 110, arranged is the lens array 102, through which light from the LED array 101 may be focused on the surface of the photosensitive drum 51. In other words, the base portion 110 supports the LED array 101 and the lens array 102.

The LED array 101 is a semiconductor device including a plurality of light emitters (LEDs), which align along the rotation axis direction. The light emitters may blink and emit light at the photosensitive drum 51 to scan the surface of the photosensitive drum 51. Meanwhile, a lower face of the lens array 102 faces toward the rotation axis X1 and forms an emitting face, from which the light may be emitted.

In the following description, a direction, along which the plurality of light emitters align in the LED array 101 to scan the photosensitive drum 51 along the rotation axis direction, may be referred to as a main scanning direction. Meanwhile, a direction of an optical axis of the light emitted from the LED array 101 may be referred to as an optical axis direction. The optical axis direction coincides with a direction extending through any one of the light emitters and a position of a focal point on the photosensitive drum 51A for the one of the light emitters. A direction orthogonal to the optical axis direction and to the main scanning direction may be referred to as a sub-scanning direction. In this regard, the sub-scanning direction may coincide with the front-rear direction in the present embodiment, and the optical axis direction may coincide with the vertical direction.

The second frame 200 supports the first frame 100. The second frame 200 hangs down from the holder 12, which is made of resin and supported pivotably by the cover 11, to be supported by the holder 12. The second frame 200 includes a base portion 210 extending approximately in a rectangular shape longer in the widthwise direction, two (2) protrusive portions 220, a first end portion 230, a second end portion 240, and a third end portion 250, which are formed integrally.

The base portion 210 includes a recess 211 and a hole 213. The hole 213 includes two (2) holes 213, which are formed at positions spaced apart from each other symmetrically with respect to a widthwise center of the base portion 210 along the widthwise direction. The holes 213 are formed through the base portion 210 in the front-rear direction.

Meanwhile, the holder 12 includes hooks 12A to be hooked with the base portion 210 at positions coincident with the holes 213. A lower end of each hook 12A protrudes inward with regard to the front-rear direction to be engaged with the hole 213. The holder 12 holds the base portion 210 with allowances with regard to the front-rear direction and the vertical direction. In this regard, the exposure head 40 is movably supported to move in the front-rear direction and in the vertical direction with respect to the cover 11 through the holder 12.

The recess 211 is open toward the holder 12. The recess 211 includes two (2) recesses 211, one and the other of which are formed at positions on one and the other outer sides of the holes 213 with regard to the widthwise direction, respectively. In a position between a bottom of each recess 211 and the holder 12, arranged is a compressive coil spring SP, which may urge the exposure head 40 toward the photosensitive drum 51.

The protrusive portions 220 may support widthwise end portions of the first frame 100 with regard to the rotation axis direction and protrude from a lower face of the base portion 210 toward the photosensitive drum 51. In particular, the protrusive portions 220 protrude beyond the lens array 102, to be closer to the photosensitive drum 51 than the lens array 102 with regard to the optical axis direction. The first frame 100 is supported by the second frame 200 with the extended portions 120 being attached to the protrusive portions 200 of the second frame 200.

Figure 4:
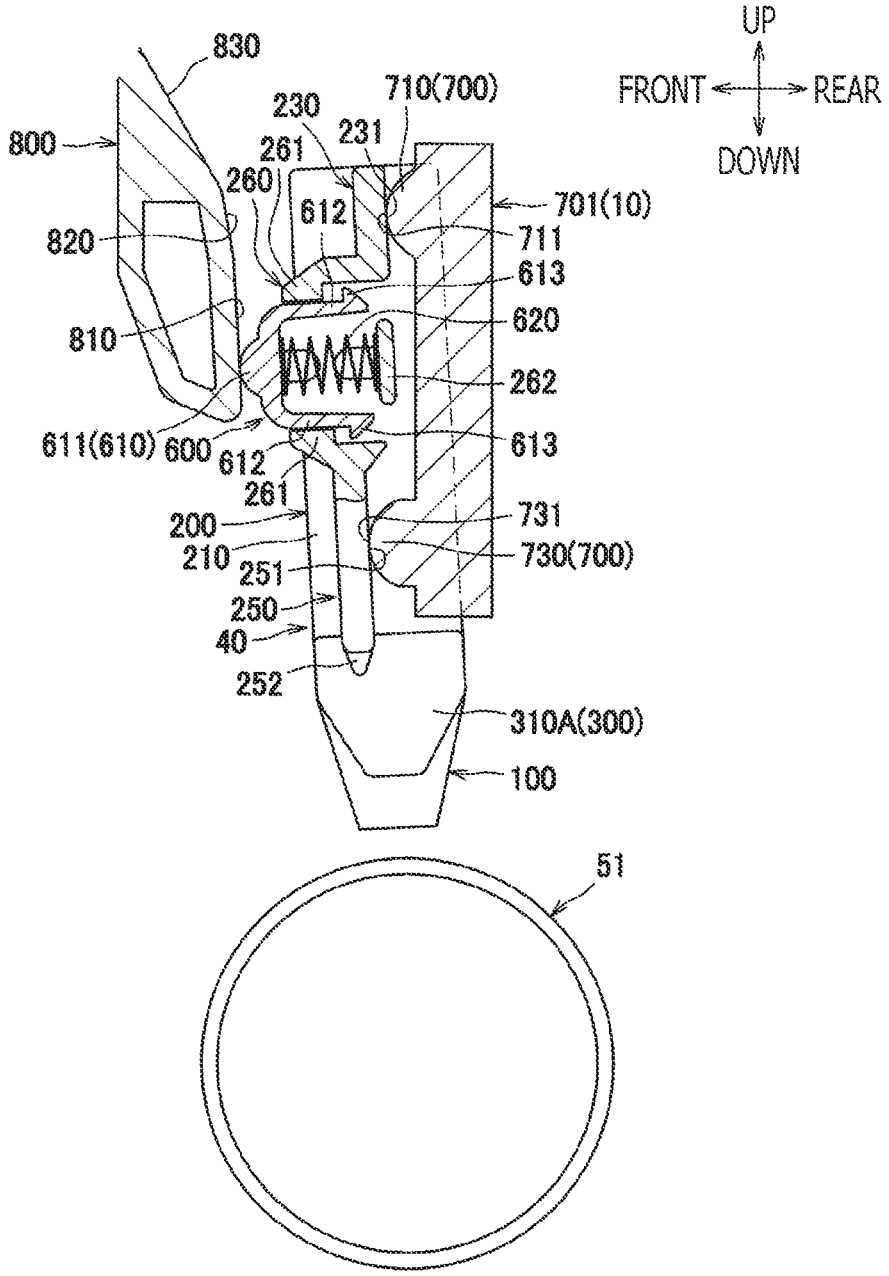
FIG. 4 is a cross-sectional view of the exposure head and the drum unit, taken at a line X-X shown in FIG. 3, according to the embodiment of the present disclosure.

The first end portion 230 and the third end portion 250 are arranged, with regard to the rotation axis direction, at positions on one side of the base portion 210, in particular, at an end area on the rightward side. With regard to the optical axis direction, as shown in FIG. 4, the first end portion 230 is arranged at a position on one side, e.g., on an upper side, of the second frame 200. With regard to the front-rear direction, the first end portion 230 is arranged in an approximately central area in the second frame 200. The first end portion 230 includes a first head-side contact face 231, which is substantially planar, on one side with regard to the sub-scanning direction, e.g., on a rearward side. The first head-side contact face 231 is arranged to contact a first reference face 710, which will be described later.

The third end portion 250 is arranged at a position apart from the first end portion 230 with regard to the optical axis direction. In particular, the third end portion 250 is arranged on the other side, e.g., on a lower side, of the second frame 200 with regard to the optical axis direction. In other words, the third end portion 250 is arranged at a position downstream from the first end portion 230 with regard to a moving direction of the exposure head 40 moving from the retracted position to the exposable position, i.e., downward.

The third end portion 250 is arranged at a position displaced from the first end portion 230 with regard to the front-rear direction. In particular, with regard to the front-rear direction, the third end portion 250 is arranged at a position on the other side, e.g., frontward, displaced from a center of the second frame 200 with regard to the front-rear direction. A lower end portion 252 of the third end portion 250 is tapered to be smaller in a dimension with regard to the front-rear direction toward the photosensitive drum 51. In this regard, in FIG. 4, it may be noted that the photosensitive drum 51 is added for better understanding to the cross-sectional view taken at the line X-X in FIG. 3.

The third end portion 250 includes a third head-side contact face 251, which is substantially planar and configured to contact a third reference face 730, on a rearward side thereof. The third reference face 730 will be described later. The third head-side contact face 251 is arranged at a position different from the first head-side contact face 231 with regard to the front-rear direction. In particular, the third head-side contact face 251 is arranged at a position displaced frontward from the first head-side contact face 231.

Figure 5:
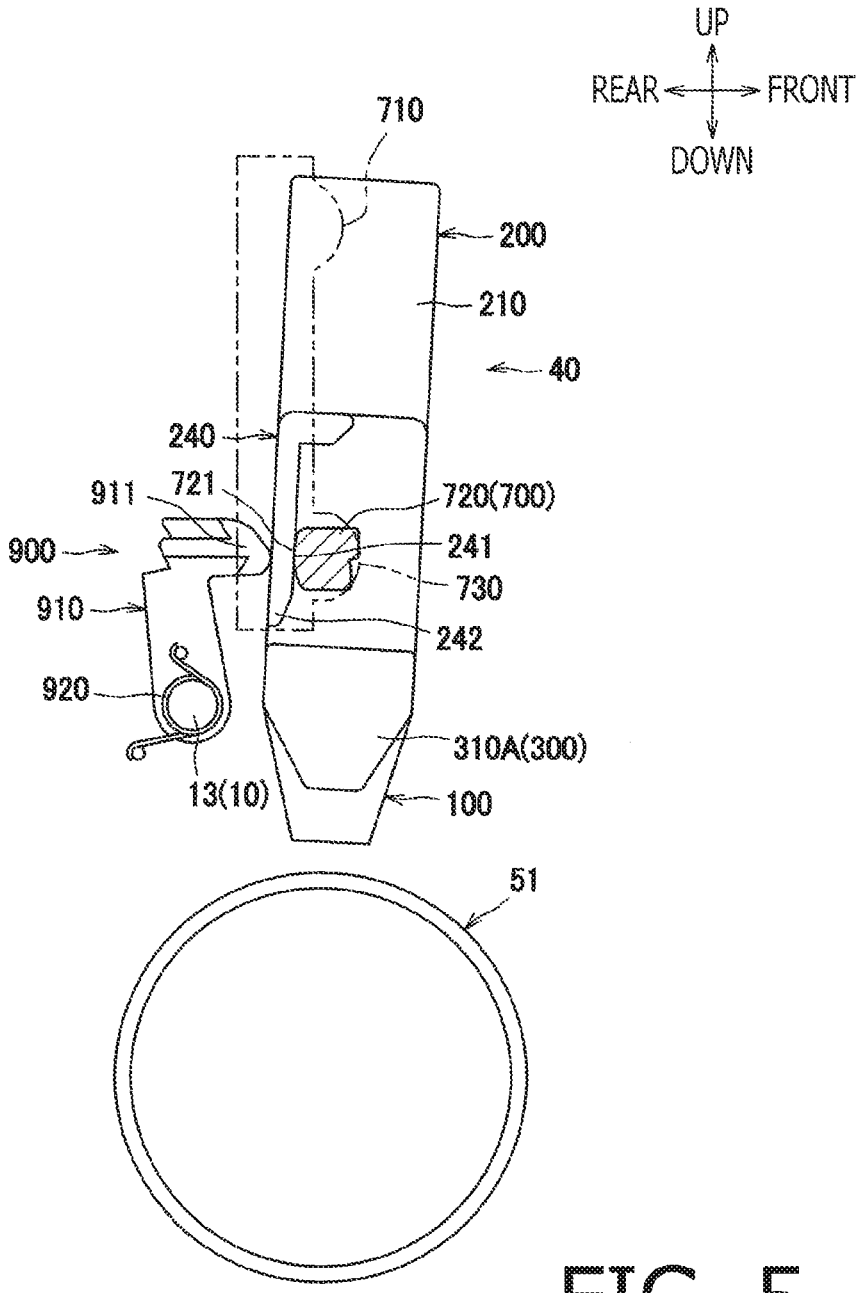
FIG. 5 is a sideward view of the exposure head and the drum unit, viewed along an arrow Y shown in FIG. 3, according to the embodiment of the present disclosure.

The second end portion 240 is, as shown in FIG. 3, arranged at a position on the other side of the base portion 210 with regard to the rotation axis direction, e.g., on the leftward side. As shown in FIG. 5, the second end portion 240 is arranged at a position on a lower side and on a rearward side within the second frame 200.

The second end portion 240 includes a lower end portion 242, which is tapered so that a frontward face of the lower end portion 242 inclines rearward as the lower end portion 242 extends toward the photosensitive drum 51, i.e., lower-rearward. The second end portion 240 includes a second head-side contact face 241, which is substantially planar and configured to contact a second reference face 720, on a frontward side thereof. The second reference face 720 will be described later.

As shown in FIG. 3, the gap-adjusting members 300 being an example of a contact portion may contact the contact faces 531 in the rotation-supporting members 500 to define the distance between the lens array 102 and the photosensitive drum 51 in the optical axis direction.

The gap-adjusting members 300 are made of resin. Each gap-adjusting member 300 includes a body 310A and a boss 310B protruding upward from the body 310A, which are formed integrally. The body 310A is tapered in the front-rear direction to be smaller toward the photosensitive drum 51, i.e., pointing downward at the photosensitive drum 51 (see FIG. 4). With the bosses 310B being inserted to the widthwise end portions of the base portion 210 from below, the gap-adjusting members 300 are attached to the second frame 200.

As shown in FIG. 4, the first presser 600 is arranged in the second frame 200 and may press the head frame of the exposure head 40, in particular, the second frame 200, toward the first reference face 710 and the third reference face 730. The first presser 600 includes a presser 610 and a spring 620.

The presser 610 is made of resin with higher slidable property, such as polyacetal (POM). The presser 610 may contact a head guide 800, which is arranged in the main frame 10 supporting the drum frames 55, when the exposure head 40 is in the exposable position. The presser 610 includes a contact body 611 and a pair of extended portions 612, which are formed integrally.

The presser 610 may contact the head guide 800 at the contact body 611. A face of the contact body 611 to contact the head guide 800 may be in a convex arced shape in a view along the rotation axis direction. The extended portions 612 extend rearward from one and the other ends of the contact body 611 with regard to the vertical direction. At a tip end of each extended portion 612A, formed is a claw 613 protruding outward with regard to the vertical direction.

The presser 610 is arranged in a guide portion 260, which is formed in the second frame 200, to be supported by the second frame 200 movably with respect to the second frame 200 in the front-rear direction. The guide portion 260 includes guide walls 261, which extend in the front-rear direction at upper, lower, rightward, and leftward edges, and a vertical wall 262. The guide walls 261 at the rightward and leftward edges are not shown.

The guide walls 261 may guide the presser 610 to move in the front-rear direction. The presser 610 may be pushed rearward with respect to the guide portion 260, and as the extended portions 612 are deformed by the inclination of the claws 612, the presser 610 may fit in the guide portion 260. Once the claws 613 pass through the guide walls 261, the extended portions 612 may return to the original shapes, and the claws 613 may be hooked with the guide walls 261 so that the presser 610 may stay in the guide portion 260 without falling off from the guide portion 260.

The spring 620 may press the presser 610 toward the head guide 800 when the exposure head 40 is in the exposable position. The spring 620 may include, for example, a compressive coil spring. The spring 620 is arranged between the presser 610 and the vertical wall 262 in the guide portion 260.

As shown in FIG. 3, the first presser 600 is arranged outside the exposable range ER for the exposure head 40 and on an outer side from the gap-adjusting member 300 with regard to the rotation axis direction. In other words, the first presser 600 is arranged on a side opposite of the exposure range ER across the gap-adjusting member 300 along the rotation axis direction.

Meanwhile, as shown in FIGS. 4 and 5, the main frame 10 includes a reference portion 700, the head guide 800, and a second presser 900. The reference portion 700 may be contacted by the second frame 200 when the exposure head 40 is in the exposable position, and the reference portion 700 being contacted by the second frame 200 may locate the exposure head 40 at a correct position with regard to the front-rear direction. In other words, by the reference portion 700 being contacted by the second frame 200 when the exposure head 40 is in the exposable position, the reference portion 700 may define a position of the exposure head 40 with regard to the front-rear direction. The reference portion 700 includes the first reference face 710, the second reference face 720, and the third reference face 730, which are mentioned earlier.

As shown in FIG. 3, the first reference face 710 and the third reference face 730 are arranged to face the rightward end portion of the exposure head 40, and the second reference face 720 is arranged to face the leftward end portion of the exposure head 40. In other words, the first reference face 710 and the third reference face 730 are arranged on a same side of the exposure head 40 with regard to the widthwise direction, and the second reference face 720 is arranged the other side of the exposure head 40 opposite to the first and second reference faces 710, 730 with regard to the widthwise direction.

Further, as shown in FIG. 4, the first reference face 710 and the second reference face 730 are arranged at positions on a side rearward from the first end portion 230 and the third end portion 250 in the second frame 200, and, as shown in FIG. 5, the second reference face 720 is arranged at a position frontward from the second end portion 240 in the second frame 200. In other words, the second reference face 720 is arranged on a side of the second end portion 240 opposite to the side of the end portions 230, 250, on which the first and third reference faces 710, 730 are arranged, with regard to the front-rear direction.

As shown in FIG. 4, the first reference face 710 and the third reference face 730 are arranged to protrude frontward from a positioning portion 701, which is arranged in the main frame 10. The positioning portion 701 including the first reference face 710 and the third reference face 730 may face the first end portion 230, the guide portion 260, and the third end portion 250 when the exposure head 40 is at the exposable position.

The first reference face 710 and the third reference face 730 are arranged to be vertically spaced apart from each other. In particular, the first reference face 710 is arranged at an upper position, and the third reference face 730 is arranged at a lower position. In other words, the third reference face 730 is arranged at a lower position, which is downstream from the first reference face 710 with regard to the moving direction of the exposure head moving from the retracted position to the exposable position.

The first reference face 710 includes a first frame-side contact face 711, which may be contacted by the first head-side contact face 231 in the second end portion 230 in the second frame 200. The third reference face 730 includes a third frame-side contact face 731, which may be contacted by the third head-side contact face 251 in the third end portion 250. The first frame-side contact face 711 and the third frame-side contact face 731 may be in convex arced shapes in a view along the rotation axis direction.

The head guide 800 may guide the exposure head 40 moving from the retracted position to the exposable position. The head guide 800 is arranged to face the positioning portion 701 at a frontward position with respect to the positioning portion 701, when the exposure head 40 is in the retracted position. When the exposure head 40 is in the exposable position, the exposure head is interposed between the positioning portion 701 and the head guide 800.

The head guide 800 includes a first guide face 810, a second guide face 820, and a third guide face 830. The second guide face 820 may guide the exposure head 40 at the first guide face 810, and the third guide face 830 may guide the exposure head 40 at the second guide face 820. The first guide face 810, the second guide face 820, the third guide face 830 incline frontward as the first guide face 810, the second guide face 820, the third guide face 830 extend upward, i.e., upper-frontward and lower-rearward, in a view along the rotation axis direction. Angles of the inclination of the first guide face 810, the second guide face 820, and the third guide face 830, with respect to the vertical direction, are greater in the order given. In other words, among the angles of the inclination of the first guide face 810, the second guide face 820, and the third guide face 830 with respect to the vertical direction, the angle of the first guide face 810 is the greatest, and the angle of the third guide face 830 is the smallest.

As shown in FIG. 5, the second reference face 720 includes a second frame-side contact face 721, which may be contacted by the second head-side contact face 241 in the second end portion 240 in the second frame 200. The second frame-side contact face 721 may be, similarly to the first frame-side contact face 711 and the third frame-side contact face 731, in a convex arced shape in a view along the rotation axis direction.

The second reference face 720 is arranged at a position coincident with the third reference face 730 in a view along the rotation axis direction. In other words, the second reference face 720 is located at a substantially same position as the third reference face 730 with regard to the moving direction of the exposure head 40 moving from the retracted position to the exposable position. Meanwhile, the first reference face 710 is located at an upward position, which is upstream from the second reference face 720 with regard to the moving direction of the exposure head 40 moving from the retracted position to the exposable position.

The second presser 900 may press the head frame of the exposure head 40, in particular, the second frame 200, toward the second reference face 720. The second presser 900 includes a pivotable arm 910 and a torsion spring 920.

The pivotable arm 910 is pivotably supported by a pivot shaft 13 arranged in the main frame 10. The pivotable arm 910 includes a protrusive portion 911 protruding frontward at an upper position thereof. The protrusive portion 911 is formed to incline upper-rearward and lower-frontward at a tip end thereof. The torsion spring 920 may apply an urging force, which may act in a clockwise direction in FIG. 5, to the pivotable arm 910.

The second presser 900 is in such an arrangement that, when the exposure head 40 is at the exposable position, the protrusive portion 911 in the pivotable arm 910 may press the second end portion 240 against the second reference face 720. When the exposure head 40 is not at the exposable position, as shown in FIG. 6B, the protrusive portion 911 abuts on the second reference face 720 to be restricted from pivoting.

A direction, in which the second presser 900 presses the second frame 200 toward the second reference face 720, is different from the direction, in which the first presser 600 presses the second frame 200 toward the first reference face 710 and the third reference face 730. In particular, the second presser 900 may press the second end portion 240 in the second frame 200 toward the side of the second reference face 720, e.g., frontward. Meanwhile, as shown in FIG. 4, the first presser 600 may, due to a reaction force to the pressure from the spring 620 pressing the presser 610 against the head guide 800, press the first end portions 230 and the third end portion 250 of the second frame 200 toward the side of the first reference face 710 and the third reference face 730, e.g., rearward.

In the following paragraphs, described will be movements of the items described above in association with the exposure head 40 moving from the retracted position (see FIG. 2) and the exposable position (see FIG. 1).

Figure 2:
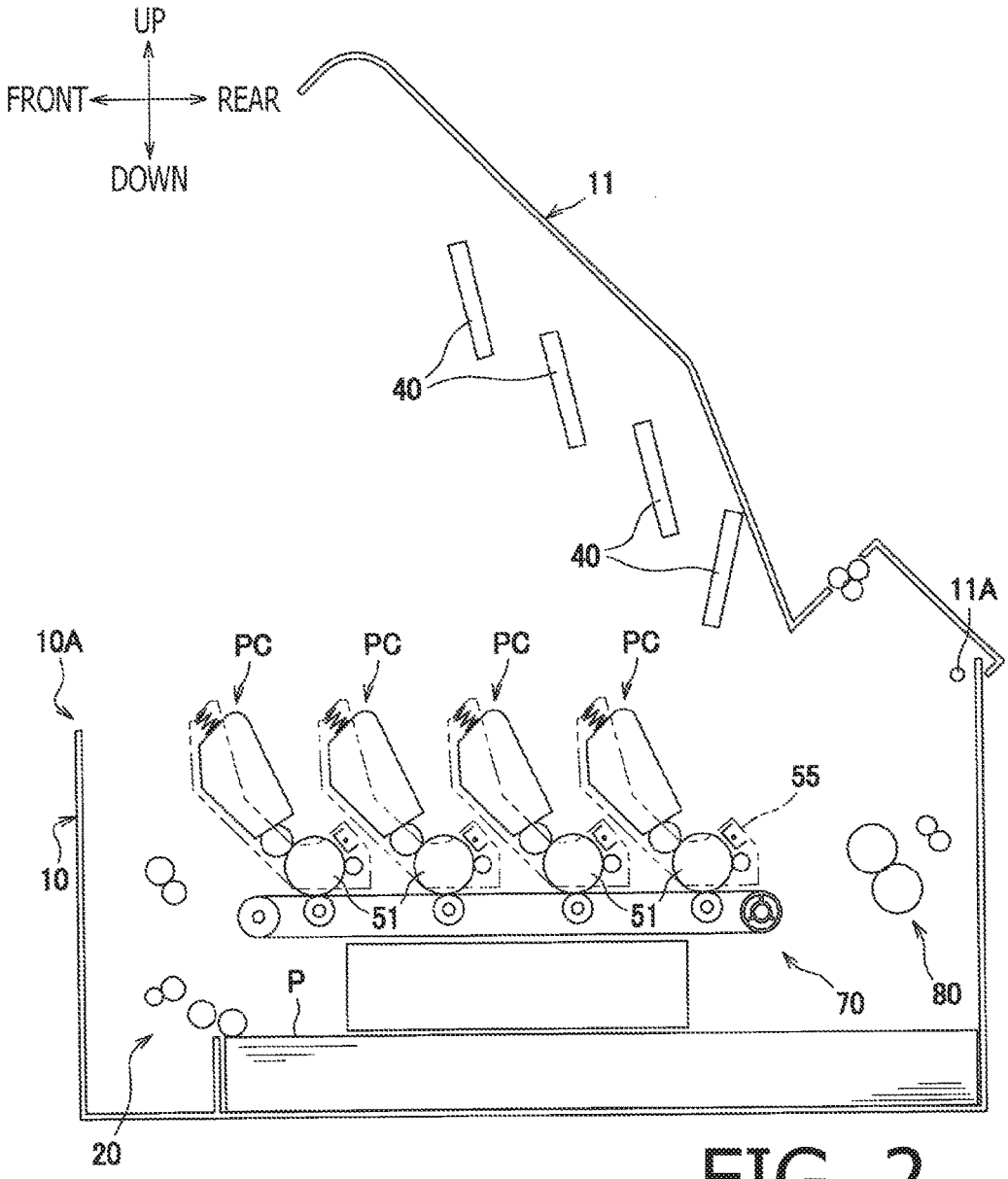
FIG. 2 is an illustrative cross-sectional view of the color printer, with a cover being open, according to the embodiment of the present disclosure.
Figure 6A:
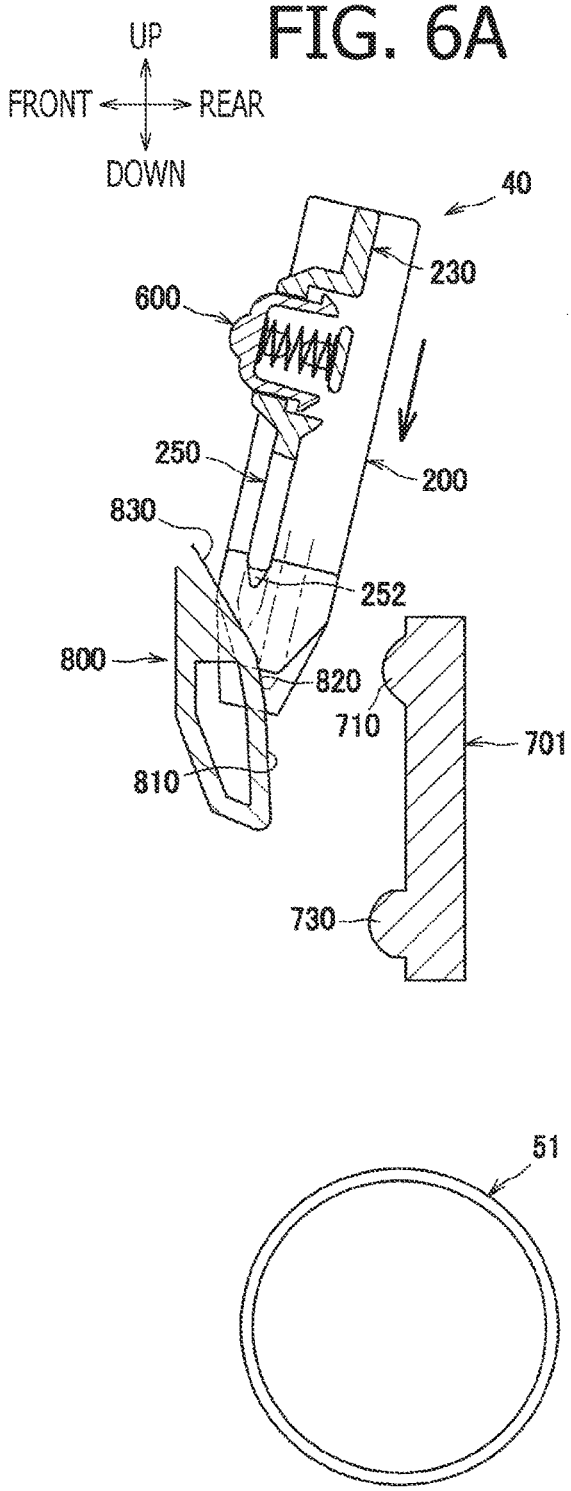
FIGS. 6A-6B illustrate a transitory position of the exposure head moving from the retracted position to the exposable position according to the embodiment of the present disclosure.
Figure 6B:
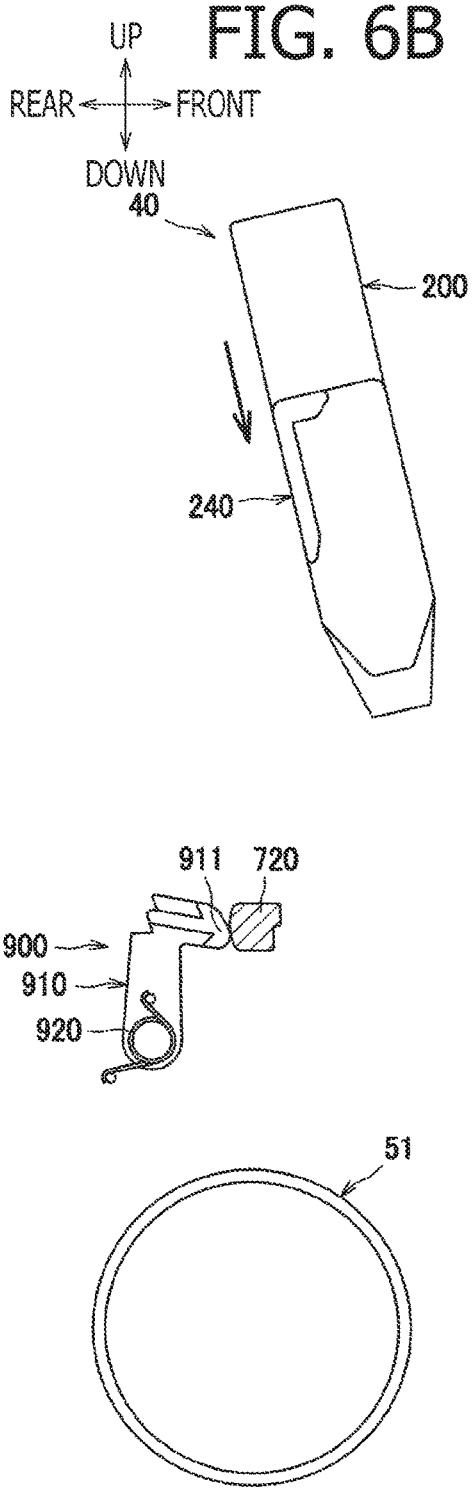

As the cover 11 is moved from the open position shown in FIG. 2 toward the closure position shown in FIG. 1 to be closed, the exposure head 40 may move downward as shown in FIGS. 6A-6B. In this flow of closing motion, the lower end portion 252 in the third end portion 250 may first contact the third guide face 830 in the head guide 800, as indicated by dash-and-dots lines in FIG. 6A.

Figure 7A:
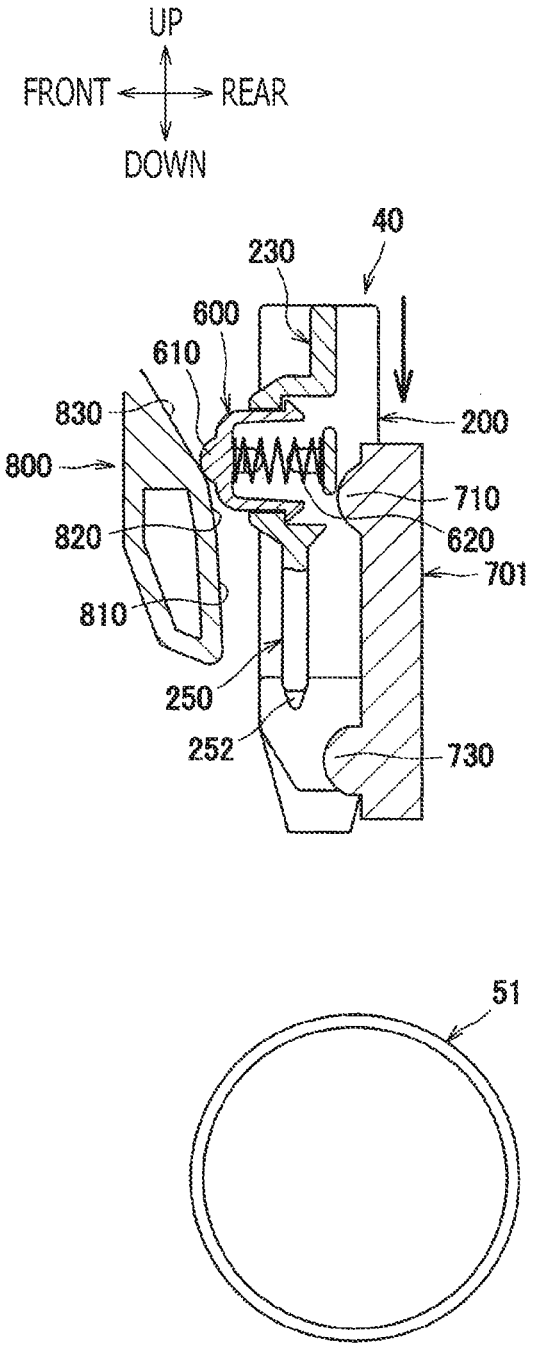
FIGS. 7A-7B illustrate another transitory position of the exposure head moving from the retracted position to the exposable position according to the embodiment of the present disclosure.
Figure 7B:
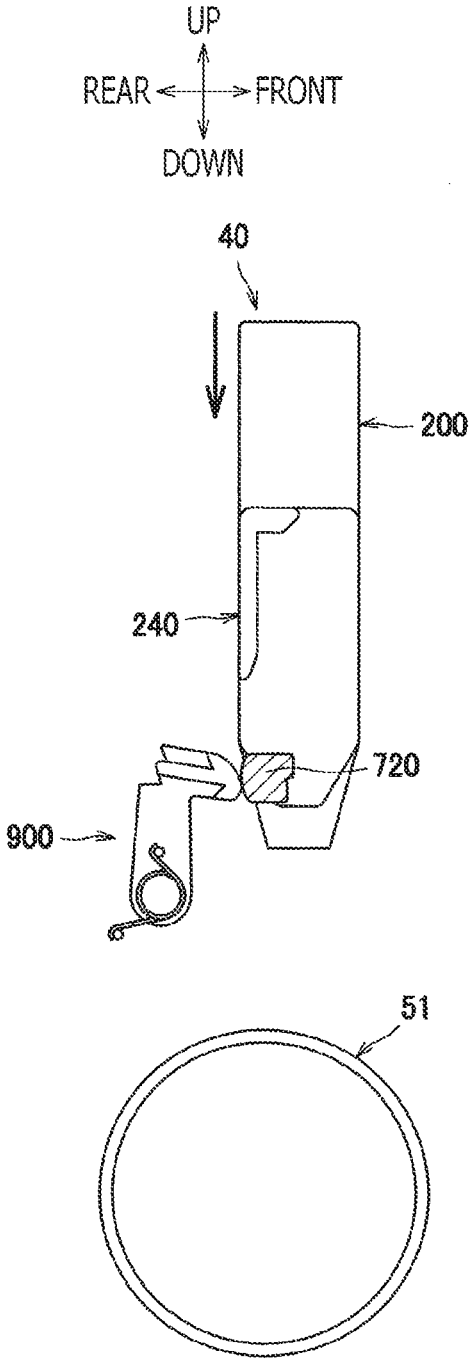

As the exposure head 40 descends, the lower end portion 252 in the third end portion 250 may slide on the third guide face 830 and continuously on the second guide face 820 in the head guide 800, and the third end portion 250 may move through an intermediate area between the first guide face 810 and the positioning portion 701. Further, as shown in FIGS. 7A-7B, the lower end portion 252 in the third end portion 250 may separate from the second guide face 820, and the third end portion 250 may enter the intermediate area between the first guide face 810 and the positioning portion 701. Thereafter, the presser 610 in the first presser 600 may contact the first guide face 830.

Figure 8A:
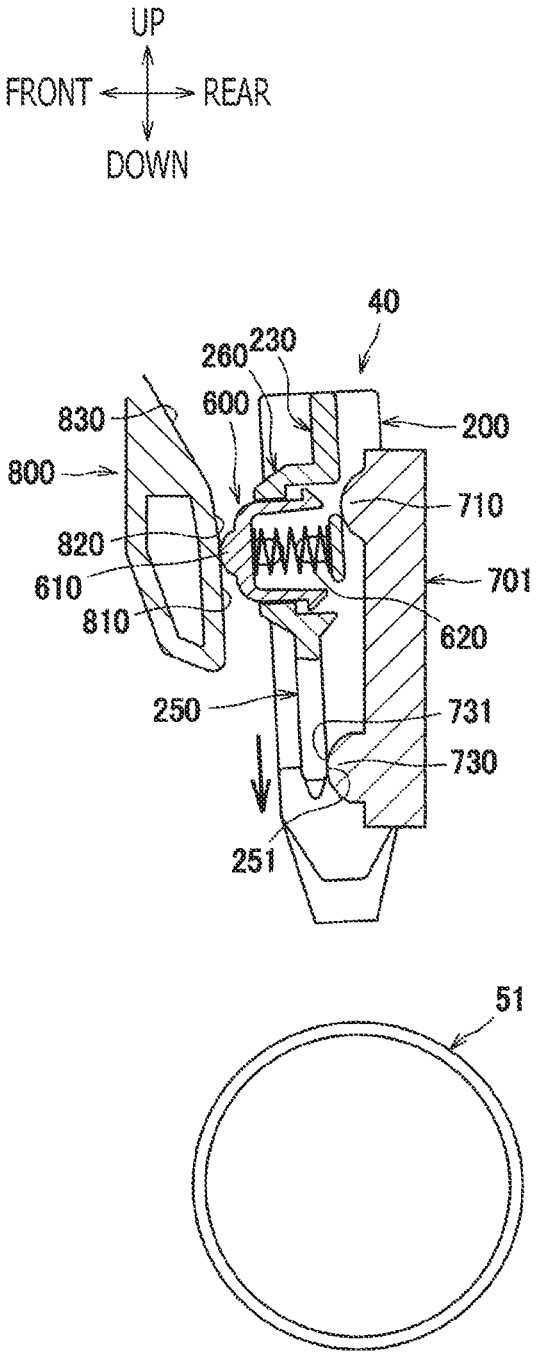
FIGS. 8A-8B illustrate another transitory position of the exposure head moving from the retracted position to the exposable position according to the embodiment of the present disclosure.
Figure 8B:
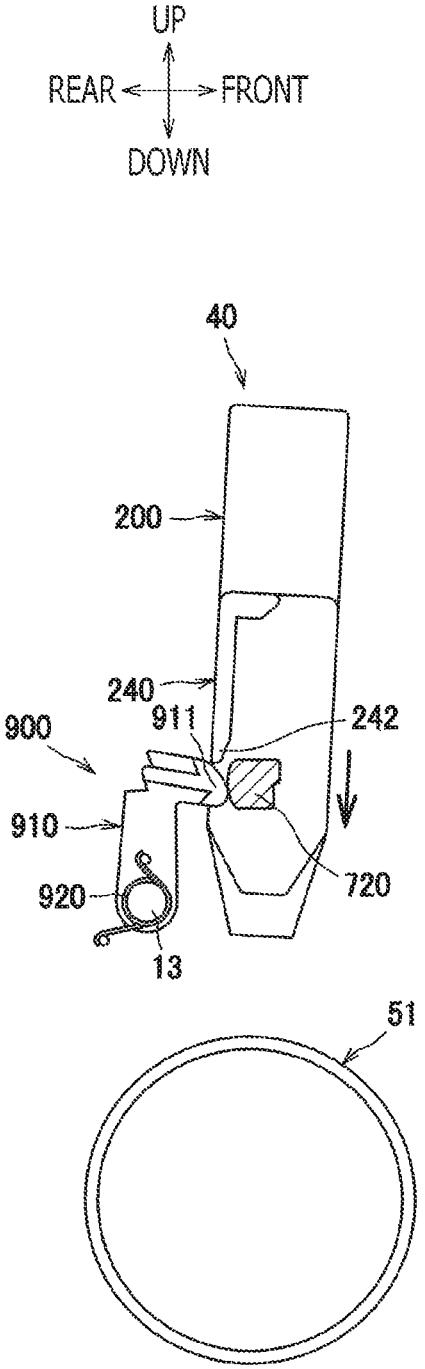

As the exposure head 40 descends further, as shown in FIGS. 8A-8B, the first presser 600 may enter the intermediate area between the positioning portion 701 and the head guide 800, and the presser 610 may compress the spring 620 to be pushed inside the guide portion 260. In this motion, the presser 610 may press the first guide face 810 by the urging force of the spring 620, the second frame 200 may be urged rearward by the reaction force to the urging force, and the third head-side contact face 251 in the third end portion 250 may contact the third frame-side contact face 731 in the third reference face 730.

By this instant in the flow of motion, the second end portion 240 has not yet entered an intermediate area between the second reference face 720 and the protrusive portion 911 in the second presser 900. As shown in FIG. 4, as the exposure head 40 further descends, the first head-side contact face 231 in the first end portion 230 may contact the first frame-side contact face 711 in the first reference face 710 due to the pressure from the first presser 600.

Meanwhile, when the exposure head 40 moves from the position shown in FIG. 8B to the position shown in FIG. 5, the lower end portion 242 of the second end portion 240 may push the inclined face of the protrusive portion 911 so that the pivotable arm 910 may pivot counterclockwise in FIG. 5 against the urging force of the torsion spring 920 and enter the intermediate area between the protrusive portion 911 and the second reference face 720. Thus, due to the pressure from the second presser 900, the second head-side contact face 241 in the second end portion 240 may contact the second frame-side contact face 721 in the second reference face 720.

Moreover, as shown in FIG. 3, with the gap-adjusting members 300 contacting the contact faces 531 in the rotation-supporting members 500, the exposure head 40 may reach the exposable position while the distance between the lens array 102 and the photosensitive drum 51 in the optical axis direction may be defined.

According to the configuration described above, benefits described below may be achievable.

That is, the first reference face 710 is arranged rearward from the second frame 200 whereas the second reference face 720 is arranged frontward from the second frame 200. Therefore, freedom for the layout of the reference portion 700 may be improved, and freedom for the layout around the exposure heads 40 may be improved. For example, since the process cartridges PC is attachable to and detachable from the main frame 10, the main frame 10 may have guides for the process cartridges PC to be attached to or detached from the main frame 10 there-along. In such a configuration, the second pressers 900 may be arranged in positions to avoid interference with the guides.

The first frame-side contact face 711 and the second frame-side contact face 721 are formed in the convex arced shapes in the view along the rotation axis direction. Therefore, the second frame 200 and the reference portion 700 may contact each other at a point or linearly. Therefore, the second frame 200 may be placed to contact preferable positions in the reference portion 700, and the position of the exposure head 40 with regard to the front-rear direction may be correctly defined. Meanwhile, sliding resistance between the second frame 200 and the reference portion 700 may be reduced so that the exposure head 40 may move between the exposable position and the retracted position smoothly.

The reference portion 700 includes the three (3) reference faces, which are the first reference face 710, the second reference face 720, and the third reference face 730. In this regard, the second frame 200 may contact the reference portion 700 at three positions. Therefore, the exposure head 40 may be placed in the correct position with regard to the front-rear direction correctly and stably.

The first reference face 710 is located at the position upstream from the second reference face 720 with regard to the moving direction of the exposure head 40 to move from the retracted position to the exposable position. Therefore, while the exposure head 40 is at the exposable position, the first presser 600 to press the second frame 200 against the first reference face 710 may be located at the position upstream from the second presser 900, which may press the second frame 200 against the second reference face 720, with regard to the moving direction of the exposure head 40. In this regard, when the exposure head 40 is moved from the retracted position to the exposable position, solely the presser 610 in the first presser 600 may be placed to act against the urging force of the spring 620 earlier, and the pivotable arm 910 in the second presser 900 may be placed to act against the urging force of the torsion spring 920 later. In other words, the first presser 600 and the second presser 900 may be activated at separate timings. Therefore, compared to a configuration, in which two pressers may be activated simultaneously, resistance against the exposure head 40 moving to the exposable position may be reduced so that the exposure head 40 may be moved to the exposable position with a lower intensity, i.e., more easily.

The cover 11 to support the exposure heads 40 is pivotable about the pivot axis 11A; therefore, by pivoting the cover 11, the exposure heads 40 may be moved between the exposable positions and the retracted positions along a pivoting track of the cover 11.

The exposure heads 40 are supported to be movable in the front-rear direction, and when the exposure heads 40 are moved from the retracted positions to the exposable positions, each second frame 200 may contact and move along the reference portion 700. Therefore, the exposure heads 40 may be located at correct positions with regard to the front-rear direction. Further, while the exposure heads 40 are movable in the vertical direction and are urged by the compressive coil springs SP toward the photosensitive drums 51, the exposure heads 40 may be located at correct positions with regard to the vertical direction. Therefore, the exposure heads 40 may expose the photosensitive drums 51 to the light preferably.

The third end portion 250, which is located at the position downstream from the first end portion 230 with regard to the moving direction of the exposure head 40 to move from the retracted position to the exposable position, is located at the position displaced frontward from the first end portion 230. Therefore, when the exposure head 40 moves from the retracted position to the exposable position, the third end portion 250, which approaches the first reference face 710 earlier, may be restrained from interfering with the first reference face 710.

The second frame 200 of the exposure head 40 has the first presser 600; therefore, a presser to press the second frame 200 against the reference faces 710, 730 may not necessarily be arranged in the main frame 10. In this regard, freedom for layout in the color printer 1 may be improved. For example, the presser to press the second frame 200 against the reference faces 710, 730, which may be in a structure similar to the second presser 900, may be arranged on one side of the exposure head 40 with regard to the rotation axis direction. In this case, a manufacturer may need to consider modifying layout or forms of the other items around the exposure head 40 in consideration of limitations that may be caused by the presser in the main frame 10 so that the presser should not interfere with these items. In this regard, according to the embodiment described above, the manufacturer may be released from such limitations.

The first presser 600 is arranged in the second frame 200, which is formed separately from the first frame 100, while the first frame 100 supports the optical parts including the LED array 101 and the lens array 102. In this arrangement, the force to press the second frame 200 against the reference faces 710, 730 may be applied to the second frame 200, while the first frame 100 may be restrained from being affected by the force. Therefore, the first frame 100 may be restrained from being deformed by the force so that the photosensitive drum 51 may be exposed to the light from the LED array 101 and through the lens array 102 preferably.

The presser 610 in the first presser 600, which may contact the first and third reference faces 710, 730, is made of resin. Therefore, slidability between the first presser 600 and the first and third reference faces 710, 730 in the main frame 10 may be improved, and the exposure heads 40 may be moved between the exposable positions and the retracted positions smoothly.

The second frame 200 includes the guide portion 260 to guide the presser 610 to move there-along. In this regard, compared to a frame that does not have such a guide portion, the presser 610 may be moved stably. Therefore, the second frame 200 for the exposure head 40 may be pressed by the presser 610 against the first and third reference faces 710, 730 correctly, and the exposure head 40 may be placed in the correct position with regard to the front-rear direction.

The first presser 600 and the second presser 900 are arranged outside the exposable range ER for the exposure head 40 with regard to the rotation axis direction. Therefore, the exposure range ER for the exposure head 40 may be restrained from being influenced by the force for pressing the second frame 200 through the first and second pressers 600, 900, and the photosensitive drum 51 may be exposed to the light from the exposure head 40 preferably.

Although an example of carrying out the invention has been described, those skilled in the art will appreciate that there are numerous variations and permutations of the image forming apparatus that fall within the spirit and scope of the disclosure as set forth in the appended claims. It is to be understood that the subject matter defined in the appended claims is not necessarily limited to the specific features or act described above. Rather, the specific features and acts described above are disclosed as example forms of implementing the claims.

Below will be described varied examples derivable from the embodiment described above. In the following examples, items or structures which are substantially the same as or similar to those described in the above embodiment may be denoted by the same reference signs, and description of those may be omitted.

For example, the first, second, and third head-side contact faces 231, 241, 251 and the first, second and third frame-side contact faces 711, 721, 731 may not necessarily be in the forms of the flat planes and the rounded forms, respectively, but may be in inverted forms, i.e., the first, second, and third head-side contact faces 231, 241, 251 may be in rounded forms whereas the first, second and third frame-side contact faces 711, 721, 731 may be in planar forms. For another example, the rounded face may be in a spherical or hemispherical form, by which the reference portion and the head frame of the exposure head 40 may contact each other at points rather than areas.

For another example, the head frame of the exposure head 40 may not necessarily be configured with the plurality of frames including the first frame 100 and the second frame 200 but may be configured with a single frame to hold the optical members such as the LED array 101, the gap-adjusting members 300, and the first presser 600.

For another example, the presser 610 in the first presser 600 may not necessarily be movable linearly along the front-rear direction but may be, for example, pivotable.

For another example, the compressive coil spring SP to urge the exposure head 40 toward the photosensitive drum 51, and the spring 620 in the first presser 600 as well, may be replaced with, for example, a blade spring or a torsion spring.

For another example, the gap-adjusting member 300 to define the distance between the lens array 102 and the photosensitive drum 51 in the optical axis direction may not necessarily be arranged to contact the rotation-supporting member 500. For example, the gap-adjusting member may be arranged to contact the drum frame 55 or the main frame 10. For another example, the member to define the distance between the lens array 102 and the photosensitive drum 51 in the optical axis direction may not necessarily be the gap-adjusting member 300 attached to the second frame 200, but a part of the head frame of the exposure head 40 may serve to define the distance between the lens array 102 and the photosensitive drum 51 in the optical axis direction.

For another example, the materials for the above-mentioned items, including the fit-in member 400 and the rotation-supporting member 500, may not necessarily be limited to those mentioned above but may be replaced with other available materials. For another example, the rotation-supporting member 500 may not necessarily be a sliding bearing but may be, for example, a ball bearing.

For another example, the LED array 101 to emit light at the photosensitive drum 51 may not necessarily include the plurality of light emitters (e.g., LEDs) but may include, for example, a single light emitter and a plurality of shutters, which may open or close light paths for the light.

For another example, the first reference face 710 may not necessarily be located at the position upstream from the second reference face 720 with regard to the moving direction of the exposure head 40 to move from the retracted position to the exposable position but may be located at a position downstream from the second reference face 720 with regard to the moving direction; i.e., the second reference face 720 may be located at a position upstream from the first reference face 710 with regard to the moving direction of the exposure head 40 to move from the retracted position to the exposable position.

For another example, the reference portion 700 may not necessarily be arranged in the main frame 10 but may be arranged in, for example, the drum frame 55. For another example, the color printer 1 may have a drawer, which may support the photosensitive drums 51 and may be movable with respect to the main frame 10, and the reference portion may be arranged on the drawer. In other words, the base frame to support the photosensitive drums 51 may include a drawer.

For another example, the first presser 600 may not necessarily be arranged at the position in one end area in the exposure head 40 with regard to the rotation axis direction but may be arranged at positions in one end area and the other end area in the exposure head 40 with regard to the rotation axis direction. For another example, the presser may be arranged on one and the other sides of the exposure head 40 with regard to the sub-scanning direction.

For another example, the first presser 600 and the second presser 900 may not necessarily be arranged in the second frame 200 and the main frame 10, respectively, but one of the pressers in the second frame 200 and in the main frame 10 may be omitted.

For another example, the present disclosure may not necessarily be applied to the color printer 1 but may be applied to another type of an image forming apparatus including, for example, a copier and a multifunction peripheral machine.

Further, the items and the parts in the configuration of the embodiment described above and the exemplary configuration may be combined arbitrarily or selectively.

What is claimed is:

1. An image forming apparatus, comprising:

a photosensitive drum;

an exposure head comprising:

a plurality of light emitters aligned along a direction of a rotation axis of the photosensitive drum;

a lens array focusing light from the light emitters on the photosensitive drum; and a head frame supporting the light emitters and the lens array, the exposure head being movable between an exposable position, in which the photosensitive drum is exposed to the light, and a retracted position, in which the exposure head is further apart from the photosensitive drum than the exposure head being in the exposable position;

a base frame supporting the photosensitive drum, the base frame comprising a reference face, the reference face being configured to define a position of the exposure head with regard to a sub-scanning direction, the sub-scanning direction being orthogonal to a direction of an optical axis of the light and to the direction of the rotation axis, by being contacted by the head frame of the exposure head when the exposure head is at the exposable position;

a presser being configured to move in the sub-scanning direction, the presser contacting the base frame; and a spring arranged in the head frame, the spring pressing the presser toward the base frame and the head frame toward the reference face, wherein the head frame includes a guide portion, the guide portion comprising a guide wall extending in the sub-scanning direction, the guide wall being configured to contact the presser and guide the presser moving in the sub-scanning direction.

2. The image forming apparatus according to claim 1, wherein the reference face is in a convex arced shape in a view along the direction of the rotation axis.

3. The image forming apparatus according to claim 1, wherein the reference face includes a first reference face arranged on one side of the base frame with regard to the direction of the rotation axis, a second reference face arranged on the other side of the base frame with regard to the direction of the rotation axis, and a third reference face arranged on the one side of the base frame with regard to the direction of the rotation axis; and wherein the first reference face and the third reference face are arranged to be spaced apart from each other in the direction of the optical axis.

4. The image forming apparatus according to claim 1, wherein the head frame includes a first frame, the first frame supporting the light emitters and the lens array, and a second frame, the second frame supporting the first frame; and wherein the spring is arranged in the second frame.

5. The image forming apparatus according to claim 4, wherein the presser overlaps the head frame in the direction of the optical axis in a view along the direction of the rotation axis.

6. The image forming apparatus according to claim 1, wherein the presser is made of resin.

7. The image forming apparatus according to claim 1, wherein the spring is arranged outside an exposable range for the exposure head with regard to the direction of the rotation axis.

8. The image forming apparatus according to claim 1, wherein the exposure head includes a contact portion configured to contact the base frame to define a distance between the lens array and the photosensitive drum along the direction of the optical axis; and wherein the spring is arranged on a side opposite of an exposable range for the exposure head across the contact portion along the direction of the rotation axis.

9. The image forming apparatus according to claim 1, wherein the presser comprises an engageable portion, the engageable portion being configured to restrict the presser from moving in a direction opposite to the reference face along the sub-scanning direction.

* * * * *